US006593891B2

(12) United States Patent
Zhang

(10) Patent No.: US 6,593,891 B2
(45) Date of Patent: Jul. 15, 2003

(54) ANTENNA APPARATUS HAVING CROSS-SHAPED SLOT

(75) Inventor: Xin Zhang, Ibaraki (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 09/981,787

(22) Filed: Oct. 19, 2001

(65) Prior Publication Data

US 2003/0076259 A1 Apr. 24, 2003

(51) Int. Cl.[7] ..... H01Q 13/10
(52) U.S. Cl. ..... 343/767; 343/770; 343/846
(58) Field of Search ..... 343/700 MS, 767, 343/770, 829, 846; H01Q 1/38, 13/10, 13/20

(56) References Cited

U.S. PATENT DOCUMENTS 4,431,998 A * 2/1984 Finken ..... 343/797
5,187,490 A * 2/1993 Ohta et al. ..... 343/770
5,402,132 A * 3/1995 Hall et al. ..... 342/432
5,489,913 A * 2/1996 Raguenet et al. ..... 343/767
6,008,763 A * 12/1999 Nystrom et al. ..... 343/700 MS
6,054,953 A * 4/2000 Lindmark ..... 343/700 MS
6,114,998 A * 9/2000 Schefte et al. ..... 343/700 MS

* cited by examiner

*Primary Examiner*—Tho Phan
(74) *Attorney, Agent, or Firm*—Foley & Lardner

(57) ABSTRACT

A primary object of the present invention is to provide a small and highly efficient antenna apparatus having a polarization diversity function with a plurality of antenna elements. A secondary object of the present invention is to provide an antenna apparatus having a broadband property. By feeding power to two radiation area 5*b* perpendicular to each other of a cross-shaped slot 4 formed on a conductive plate 3, polarization diversity is performed. By forming a plurality of such cross-shaped slots 4 in one line on one conductive plate 3*a*, attaching a crossing area potential-relaxing conductive part 5*a* on the backside of a crossing 4*a* of each slot 4 on the dielectric substrate 3*a* and attaching a radiation area potential-relaxing conductive parts 5*b* on the backside of a radiation area 4*b* of each slot 4, a small and highly efficient antenna apparatus can be obtained. Also by providing an electric characteristics adjusting plate 17 on one face of the dielectric, an antenna apparatus having a broadband property can be obtained.

17 Claims, 17 Drawing Sheets

ANTENNA APPARATUS HAVING CROSS-SHAPED SLOT

BACKGROUND OF THE INVENTION

1. Field of the Invention

The present invention relates to an antenna apparatus, and more specifically, relates to an antenna apparatus in which an antenna element comprising a conductive plate having a slot formed thereon is attached to a dielectric substrate.

2. Prior Art

There is an antenna apparatus having an antenna element having a straight-line notch (hereinafter referred to as a "slot") formed on a conductive plate attached to a dielectric substrate (hereinafter referred to as a "slot antenna"). By feeding power to the slot of this antenna apparatus from a high frequency power source, the electromagnetic field resonates in the slot to thereby radiate radio wave. This kind of slot antenna has excellent electric characteristics, and hence is used in a wide range of application.

The above-described slot antenna, however, is suitable for being used as a single antenna, but it is difficult to use it as a polarization diversity antenna. It is also difficult to arrange a plurality of slot antennas, due to a restriction in the antenna size or the like. Moreover, by arranging a plurality of slot antennas on the space for one slot antenna, interference between antennas increases, and hence practical use of such an antenna has been difficult.

SUMMARY OF THE INVENTION

It is therefore a primary object of the present invention to provide a small and highly efficient antenna apparatus having a polarization diversity function with a plurality of antenna elements. A secondary object of the present invention is to provide an antenna apparatus having a broadband property.

In order to achieve the above objects, a first aspect of the present invention provides an antenna apparatus in which an antenna element comprising a conductive plate having a slot formed thereon is attached to a dielectric substrate, wherein the antenna element comprises: a conductive plate attached to one face of the dielectric substrate and having a cross-shaped slot formed thereon; a crossing area potential-relaxing conductive part attached at the position of a crossing of the cross-shaped slot on the other face of the dielectric substrate; and a strip-shaped radiation area potential-relaxing conductive parts attached at the position of a radiation area of the cross-shaped slot on the other face of the dielectric substrate.

A second aspect of the present invention provides an antenna apparatus in which an antenna element comprising a conductive plate having a slot formed thereon is attached to a dielectric substrate, wherein the antenna element comprises: a conductive plate attached to one face of the dielectric substrate and having a plurality of cross-shaped slots formed thereon; a crossing area potential-relaxing conductive part attached at the position of each crossing of each cross-shaped slot on the other face of the dielectric substrate; and a strip-shaped radiation area potential-relaxing conductive parts attached at the position of each radiation area of each cross-shaped slot on the other face of the dielectric substrate.

In addition to the above construction, the antenna apparatus of the present invention is preferably such that a reflecting plate consisting of a conductor is provided on the other face of the dielectric substrate, via spacers in parallel thereto, so as to cover the dielectric substrate.

In addition to the above construction, the antenna apparatus of the present invention is preferably such that an electric characteristics adjusting plate consisting of a conductor is provided on one face of the dielectric substrate, via spacers in parallel to the dielectric, so as to cover the central portion of each cross-shaped slot.

In addition to the above construction, the antenna apparatus of the present invention may have a notch formed on the electric characteristics adjusting plate.

In addition to the above construction, the electric characteristics adjusting plate of the antenna apparatus of the present invention may comprise another dielectric substrate, a main non-feeding element attached on the other dielectric substrate, and a plurality of strip-shaped sub non-feeding element attached in parallel to an opposing side of the main non-feeding element on the other dielectric substrate.

In addition to the above construction, a notch may be formed on at least either one of the main non-feeding element or the sub non-feeding element of the antenna apparatus of the present invention.

In addition to the above construction, in the antenna apparatus of the present invention, it is desired that power is fed in parallel to the radiation area of each slot.

According to the present invention, by feeding power to two radiation areas perpendicular to each other of the cross-shaped slot formed on the conductive plate, polarization diversity is performed. By forming a plurality of such cross-shaped slots on the conductive plate, attaching the crossing are a potential-relaxing conductive part on the backside of the crossing of each slot on the dielectric substrate and attaching the radiation area potential-relaxing conductive parts on the backside of the radiation area of each slot, a small and highly efficient antenna apparatus can be obtained. Also by providing the electric characteristics adjusting plate on one face of the dielectric, an antenna apparatus having a broadband property can be obtained.

According to the present invention, the following excellent effects can be exerted.

A plurality of antenna elements can realize a small and highly efficient antenna apparatus having a polarization diversity function, an antenna apparatus having a broadband property can be also provided.

DESCRIPTION OF THE PREFERRED EMBODIMENTS

Embodiments of the present invention will now be described in detail, with reference to the accompanying drawings.

Figure 1:
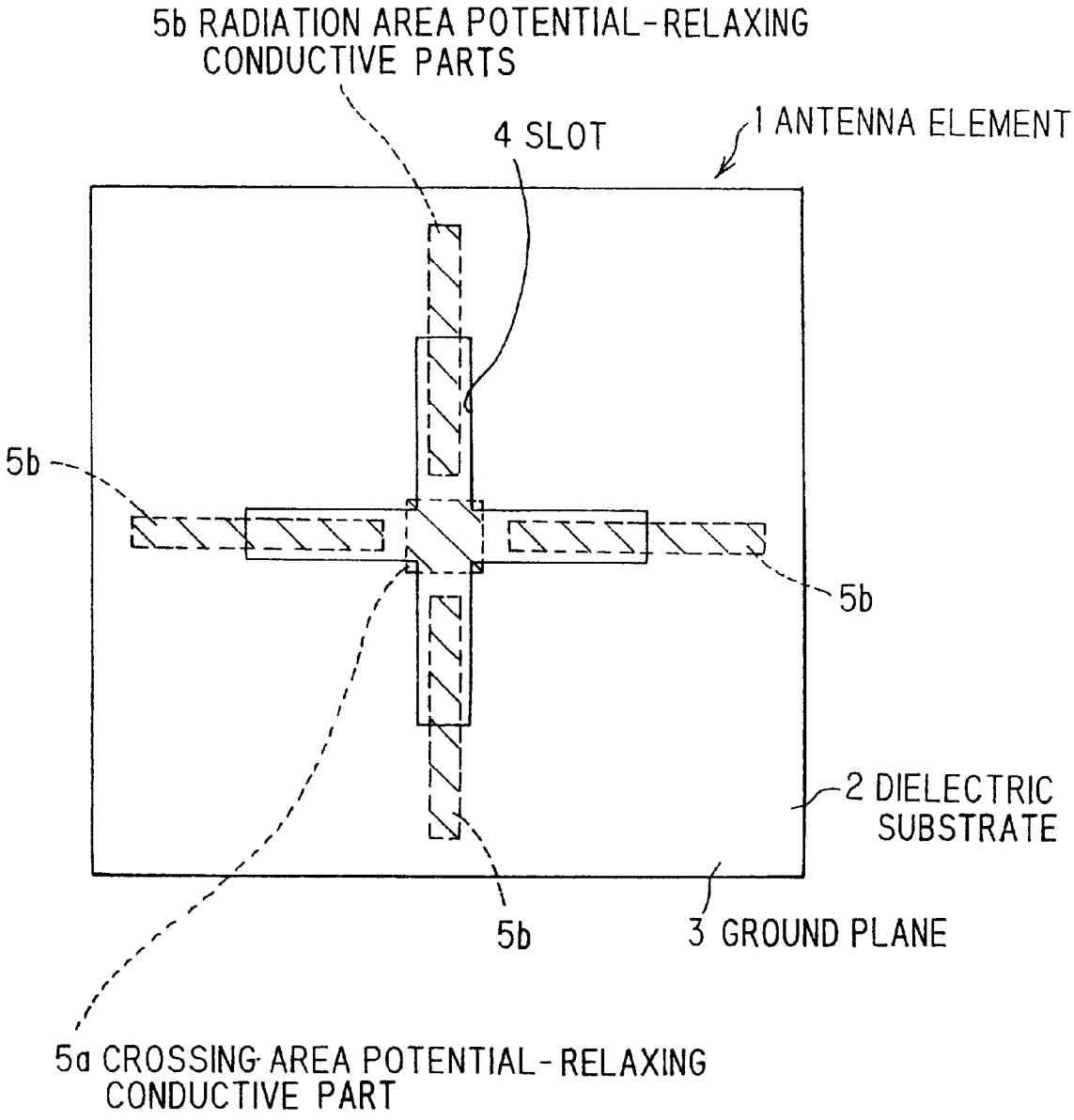
FIG. 1 is an elevational view showing one embodiment of an antenna element used in the antenna apparatus of the present invention.
Figure 2:
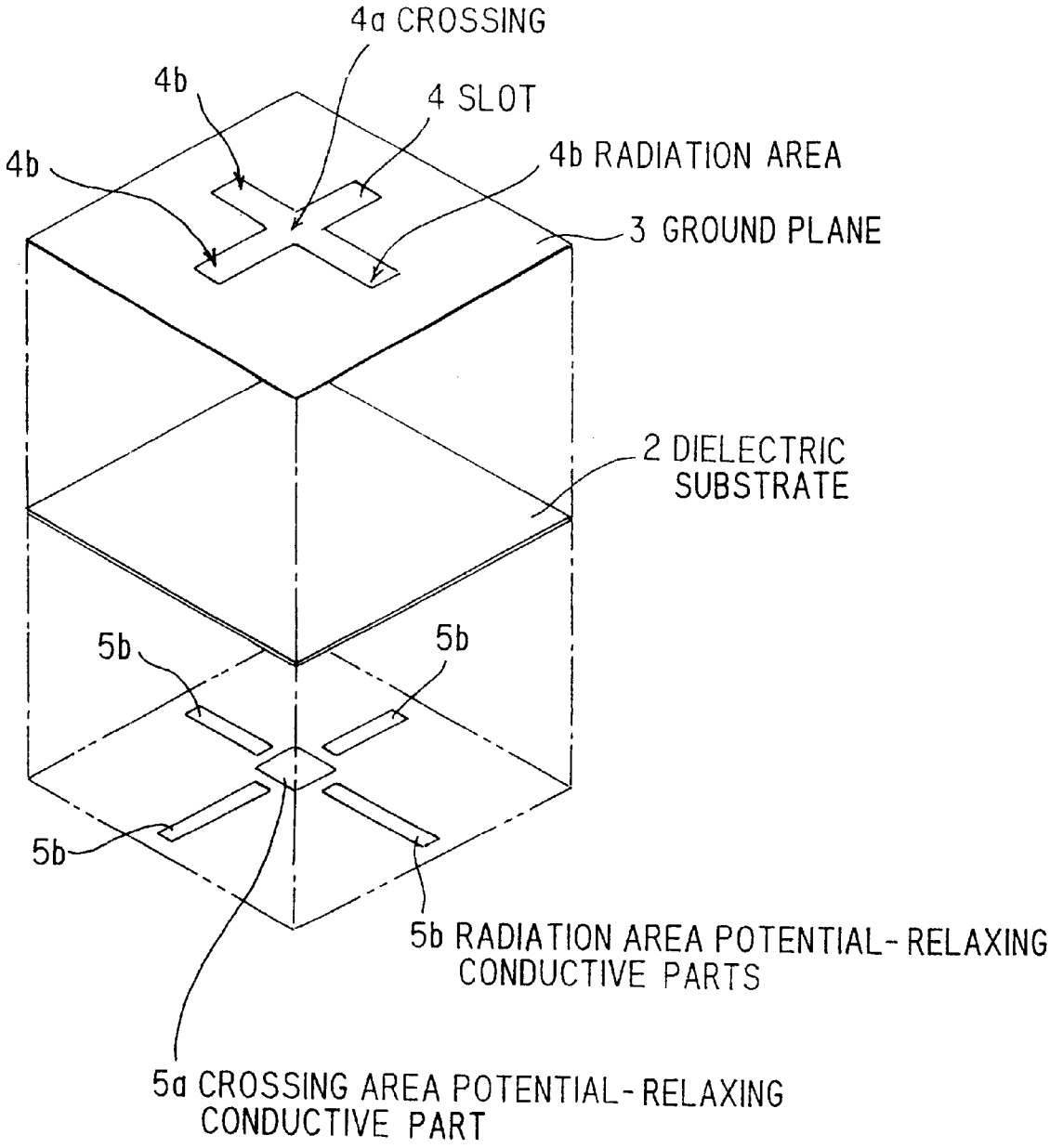
FIG. 2 is an exploded perspective view of the antenna element shown in FIG. 1.

FIG. 1 is an elevational view showing one embodiment of an antenna element used in the antenna apparatus of the present invention. FIG. 2 is an exploded perspective view of the antenna element shown in FIG. 1.

The antenna element 1 is formed such that a conductive plate 3 having a cross-shaped slot 4 formed thereon is attached on one face (the upper face in FIG. 2) of a dielectric substrate 2, and a crossing area potential-relaxing conductive part 5*a* is attached on the other face of the dielectric substrate 2 (the lower face in FIG. 2), at the position of a crossing 4*a* of the cross-shaped slot 4, and a strip-shaped radiation area potential-relaxing conductive parts 5*b* is attached at the position of a radiation area 4*b* of the cross-shaped slot on the other face of the dielectric substrate 2.

This antenna element 1 is formed by using a printed circuit board in which a conductive plate (foil) 3 consisting of a copper plate or an aluminum plate is formed on the opposite faces of the dielectric substrate 2, forming a cross-shaped slot 4, for example, by a method of etching the conductive plate 3 on the one face, and leaving the crossing area potential-relaxing conductive part 5*a* and the radiation area potential-relaxing conductive parts 5*b* by a method of etching the other face thereof.

Figure 3:
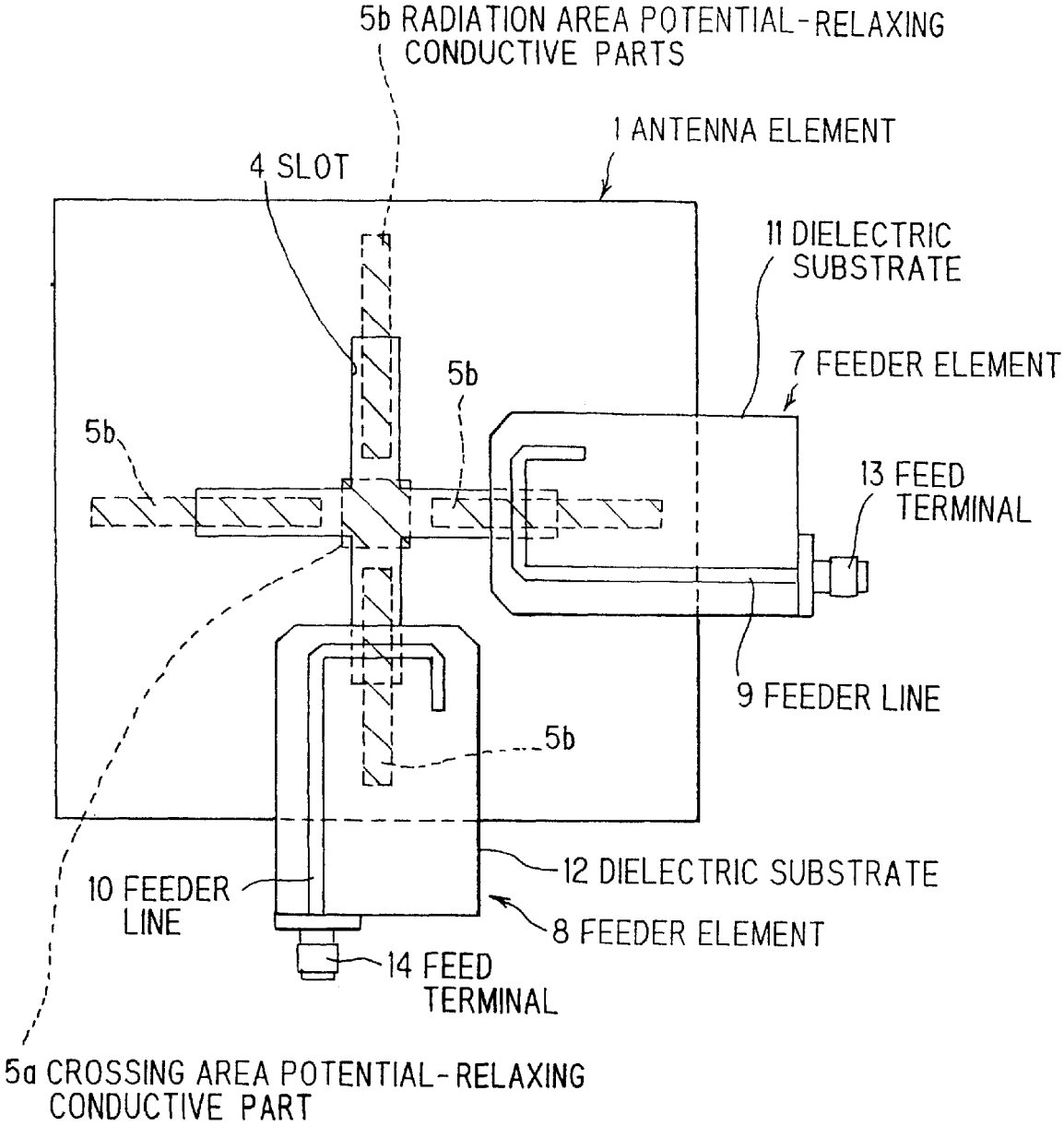
FIG. 3 is an elevational view showing an antenna apparatus in which a feeder line is attached to the antenna element shown in FIG. 1.
Figure 4:
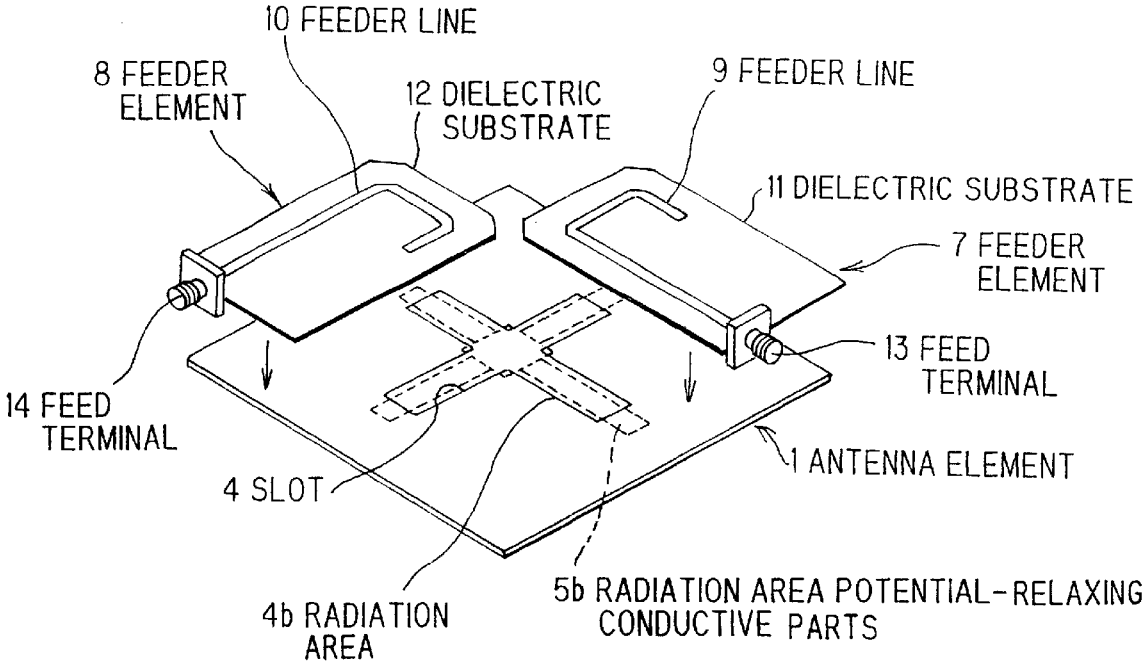
FIG. 4 is an exploded perspective view of the antenna apparatus shown in FIG. 3.

FIG. 3 is an elevational view showing an antenna apparatus in which a feeder line is attached to the antenna element shown in FIG. 1, and FIG. 4 is an exploded perspective view of the antenna apparatus shown in FIG. 3.

In this antenna apparatus, two feed elements 7, 8 are attached on the adjacent two radiation areas 4*b* of the slot 4 on the conductive plate 3 of the antenna element 1. The feed element 7 comprises a dielectric substrate 11, a feeder line 9 formed on the dielectric substrate 11 and consisting of a conductor, and a feed terminal 13 electrically connected to the feeder line 9. The feed element 8 comprises, similarly, a dielectric substrate 12, a feeder line 10 and a feed terminal 14.

The feeder lines 9, 10 are constituted by using a printed circuit board in which a conductive plate (foil) such as a copper plate or an aluminum plate is formed on one face of the dielectric substrate 11 (12) (the upper face in the figure), leaving the feeder line 9 (10) by a method of etching the conductive plate, etc., attaching the feed terminal 13 (14) to the end portion of the printed circuit board, and connecting it to the feeder line 9 (10).

The feed element 7 (8) is constructed such that the feeder line 9 (10) is attached so as to cross the radiation area 4*b* of the slot 4, and high frequency power source (not shown) is fed from the feed terminal 13 (14).

According to such an antenna apparatus, since the slot 4 has a cross shape obtained by making two straight-line slots cross each other, electromagnetic wave vibrating in the longitudinal direction (for example, vertical polarization) and electromagnetic wave vibrating in the lateral direction (for example, horizontal polarization) can be radiated. This antenna apparatus functions so that the crossing area potential-relaxing conductive part 5*a* and the radiation area potential-relaxing conductive parts 5*b* suppress the occurrence of cross-polarization components, and hence the main radio components can be efficiently radiated.

The antenna element 1 in this antenna apparatus radiates radio waves symmetrically in the one face direction (hereinafter referred to as "forward") and in the other face direction (hereinafter referred to as "rearward") of the dielectric substrate 2. When this radio wave has a single directional pattern radiated only in the forward direction, the antenna apparatus may have a construction that a reflecting plate is provided rearward.

Figure 5:
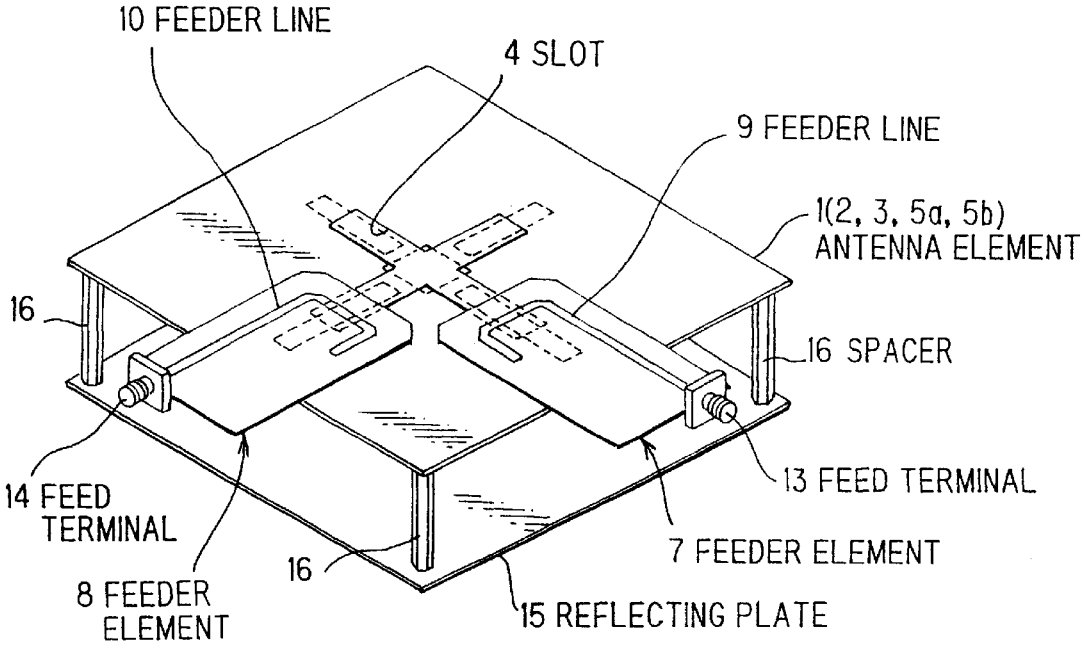
FIG. 5 is an appearance perspective view showing the appearance in another embodiment of the antenna apparatus of the present invention.

FIG. 5 is a appearance perspective view showing the appearance in another embodiment of the antenna apparatus of the present invention.

The different point from the antenna apparatus shown in FIG. 3 is that the radio wave is radiated only in the forward direction.

In the antenna apparatus shown in FIG. 5, a reflecting plate 15 consisting of a conductor is provided in parallel to the antenna apparatus via spacers 16 at the rear of the antenna apparatus shown in FIG. 3, so as to cover the antenna apparatus.

According to this antenna apparatus, since the radio wave radiated from the antenna element 1 is reflected at the rear, the radio wave can be radiated forward efficiently.

In order to enlarge the band property of the radio wave radiated from this antenna apparatus, it is desired to provide a non-feeding element as the electric characteristics adjusting plate, on one face direction of the antenna element.

Figure 6:
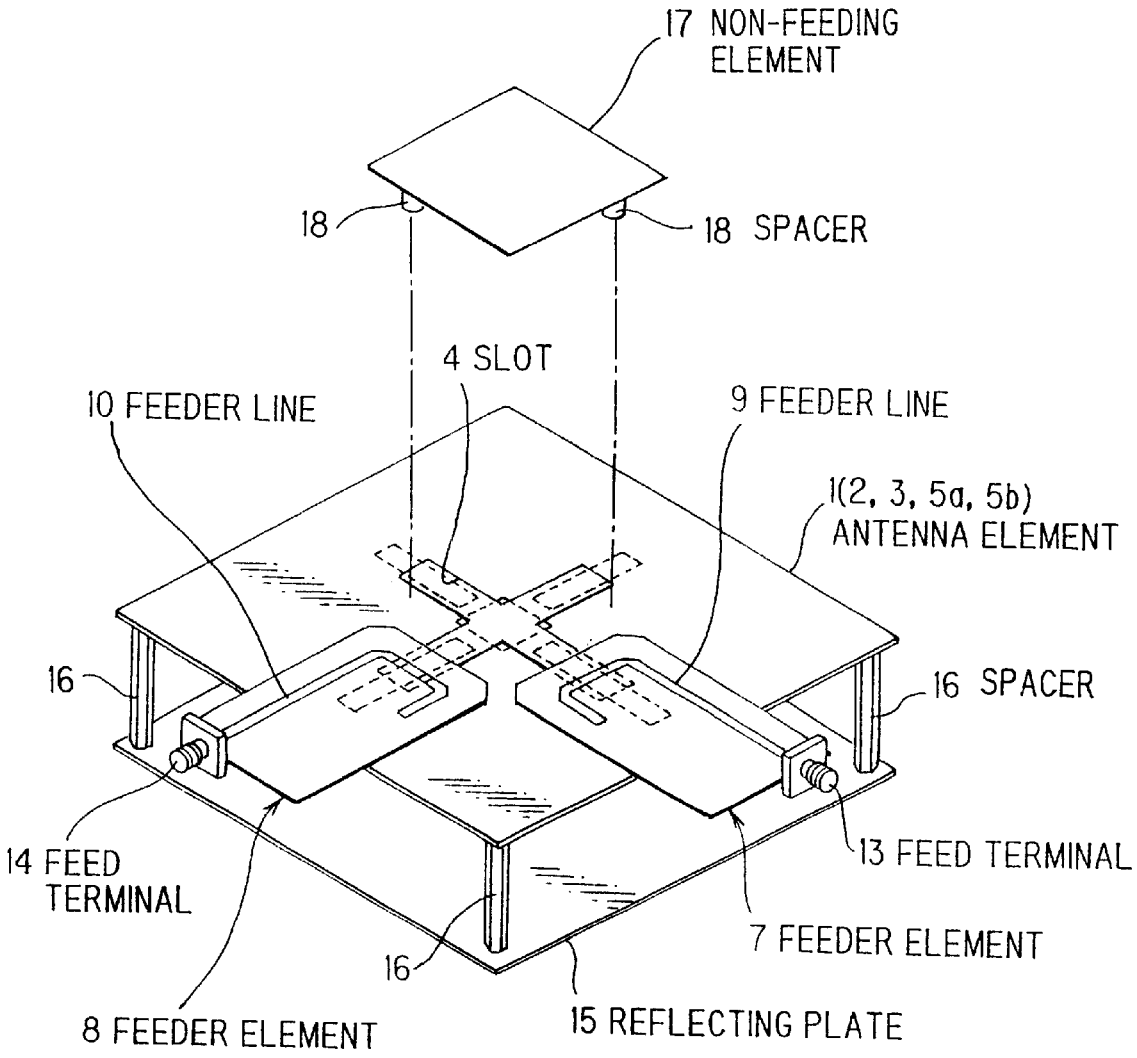
FIG. 6 is an exploded perspective view showing another embodiment of the antenna apparatus of the present invention.

FIG. 6 is an exploded perspective view showing another embodiment of the antenna apparatus of the present invention.

The different point from the antenna apparatus shown in FIG. 5 is that the non-feeding element is provided on one face of the dielectric.

This antenna apparatus has a construction that a non-feeding element 17 as the electric characteristics adjusting plate is provided so as to face the slot 4 with a predetermined space, at the front of the antenna apparatus shown in FIG. 5. This non-feeding element 17 is formed of a conductive plate, and attached at a position where it can work for relieving the frequency characteristics, at the front of the antenna element 1 by spacers 18.

According to this antenna apparatus, the radio wave from the antenna element 1 is radiated forward with directivity, the radio wave can be radiated efficiently with a broadband property by means of the non-feeding element 17.

Here, an antenna apparatus in a ground station in the mobile phone system is constituted by arranging a plurality of antenna elements in a line in the perpendicular direction in order to enhance the transmission and reception ability.

Figure 7:
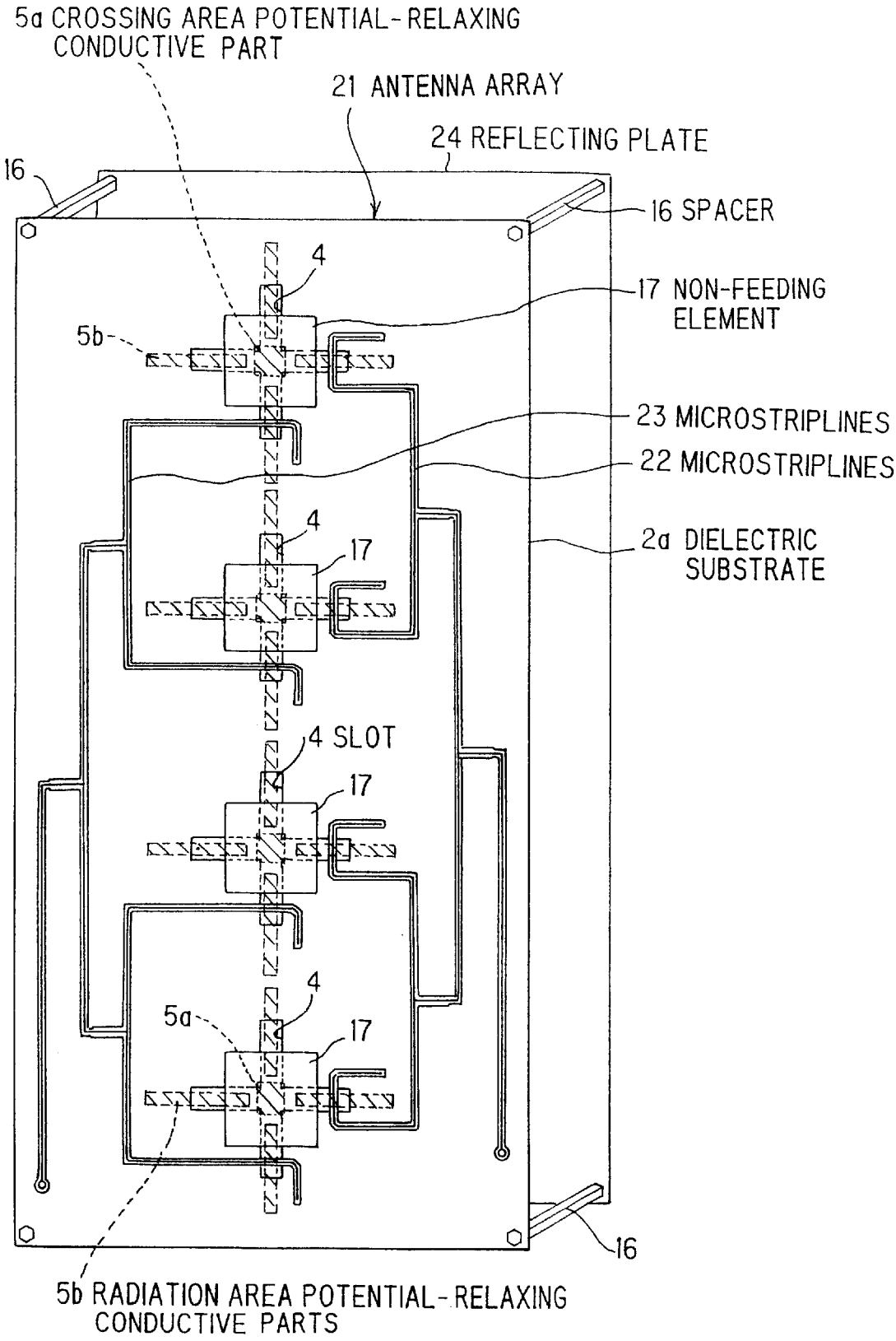
FIG. 7 is a appearance perspective view showing the appearance in another embodiment of the antenna apparatus of the present invention.

FIG. 7 is a perspective view showing the appearance in another embodiment of the antenna apparatus of the present invention.

In this antenna apparatus, a plurality of cross-shaped slots 4 is formed in the longitudinal direction on a rectangular dielectric substrate 2*a* having a size for a plurality of antenna elements (four in the figure, but the number is not limited thereto), and a crossing area relieving conductive plate 5*a* and a radiation area potential-relaxing conductive parts 5*b* are attached thereto corresponding to each slot 4, to thereby form a antenna array 21. Power is fed in parallel by microstriplines 22, 23 formed by etching a conductive plate adhered to one face of the dielectric substrate 2*a*. A reflecting plate 24 is provided at the rear of this antenna array 21, and non-feeding elements 17 are attached at the front of each slot 4, respectively.

By arranging such a antenna array 21 perpendicularly, an antenna apparatus having a property obtained by arranging a plurality of antenna elements perpendicularly can be obtained with a simple construction.

Figure 8:
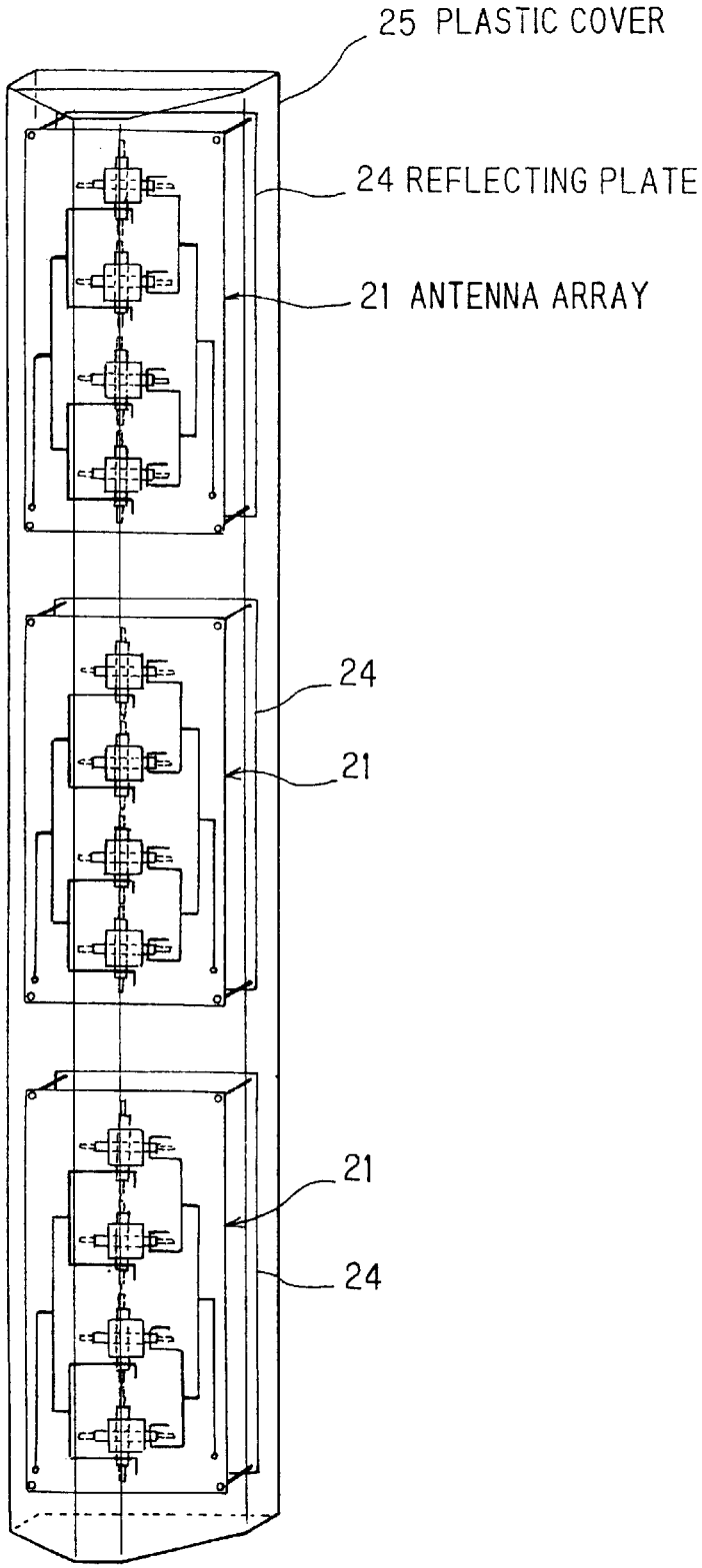
FIG. 8 is a appearance perspective view showing the appearance of a modified embodiment of the antenna apparatus of the present invention.

FIG. 8 is a perspective view showing the appearance of a modified embodiment of the antenna apparatus of the present invention.

With this antenna apparatus, a multiple-string longitudinal antenna apparatus is formed by arranging the antenna array 21 shown in FIG. 7 in plural stages (three stages in the figure, but the number of stages is not limited thereto) in the perpendicular direction, and covering these with a plastic cover 25.

FIG. 9 to FIG. 15 are exploded perspective views showing modified embodiments of the antenna apparatus of the present invention. That is to say, in the antenna apparatus shown in FIG. 9 to FIG. 15, by changing the shape of the non-feeding element in the antenna apparatus shown in FIG. 6, the impedance is adjusted, to thereby change the frequency characteristics.

Figure 9:
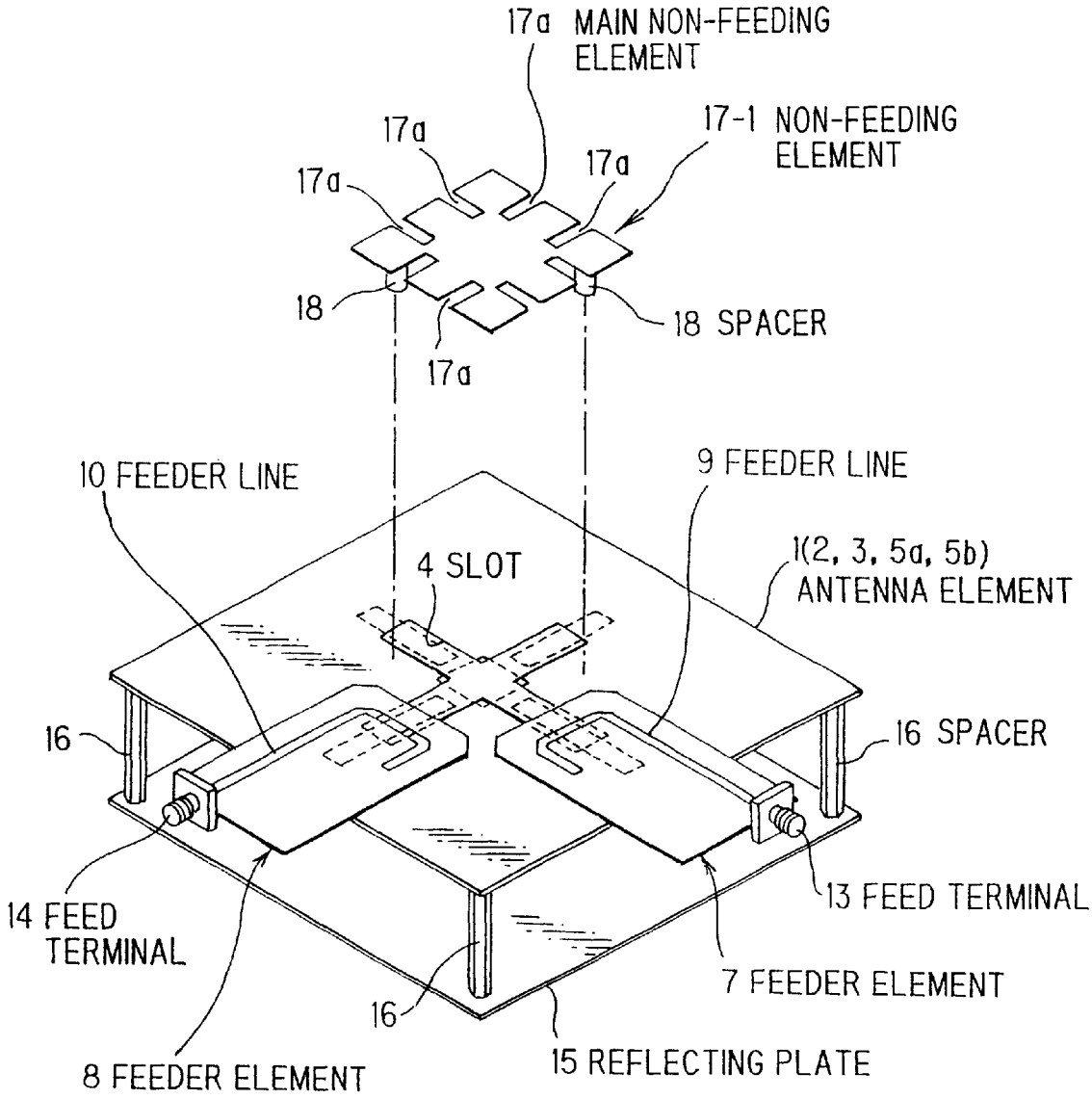
FIG. 9 is an exploded perspective view showing a modified embodiment of the antenna apparatus of the present invention.

With the modified embodiment shown in FIG. 9, the impedance is adjusted by a non-feeding element 17-1 in which a plurality of notches 17*a* (four in the figure, but the number of notches is not limited thereto) is formed at the edge on the outer periphery of the conductive plate, to thereby change the radio property.

Figure 10:
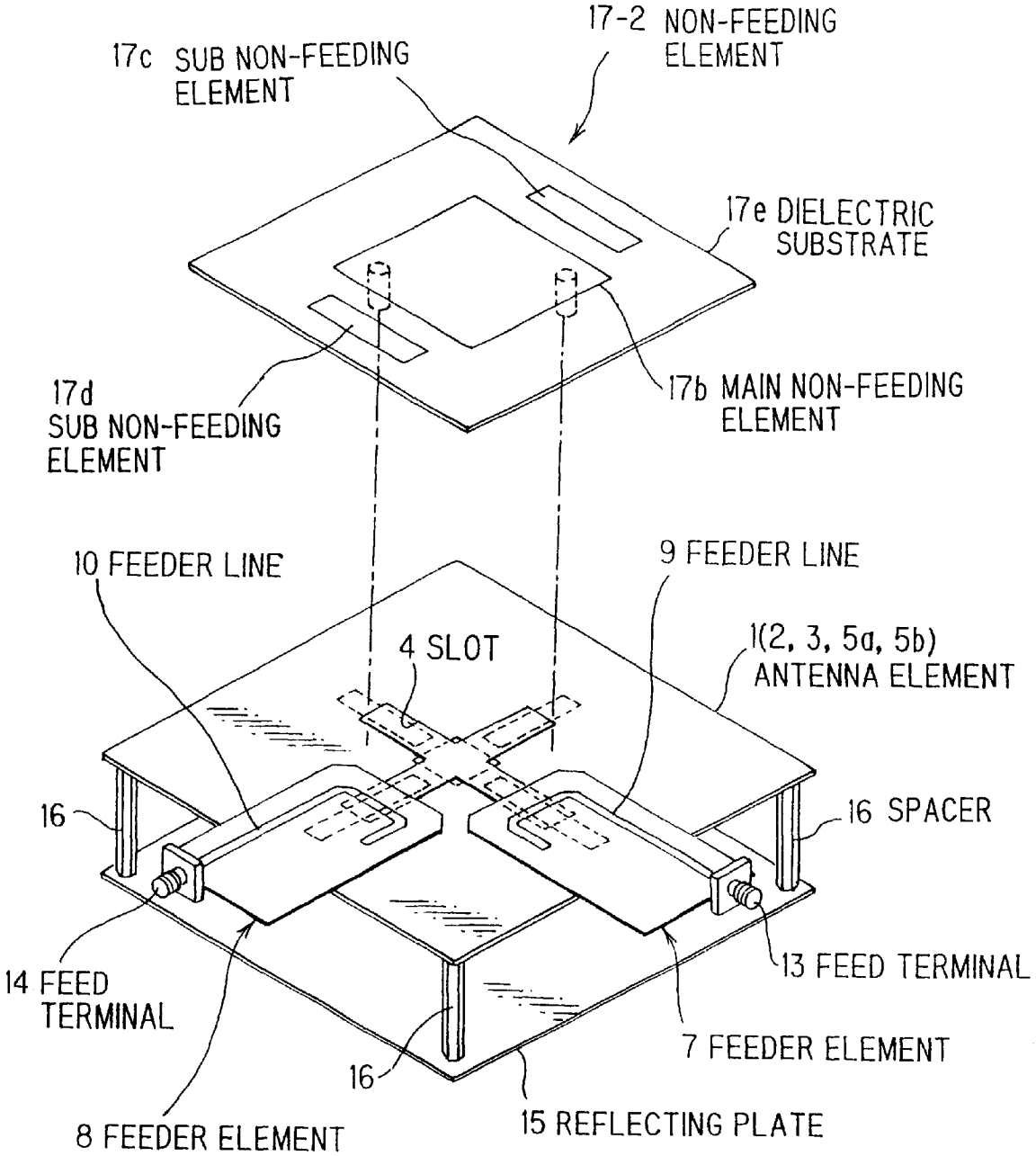
FIG. 10 is an exploded perspective view showing a modified embodiment of the antenna apparatus of the present invention.

With the modified embodiment shown in FIG. 10, a non-feeding element 17-2 comprises a dielectric substrate 17*e*, a main non-feeding element 17*b* attached at the center of the dielectric substrate 17*e*, and sub non-feeding elements 17*c*, 17*d* attached on the both sides of the main non-feeding element 17*b*. The impedance is adjusted by the main non-feeding element 17*b* and the sub non-feeding elements 17*c*, 17*d*, to thereby change the radio property.

The main non-feeding element 17*b* and the sub non-feeding elements 17*c*, 17*d* are formed by etching a dielectric substrate having a conductive plate adhered on one face thereof.

Figure 11:
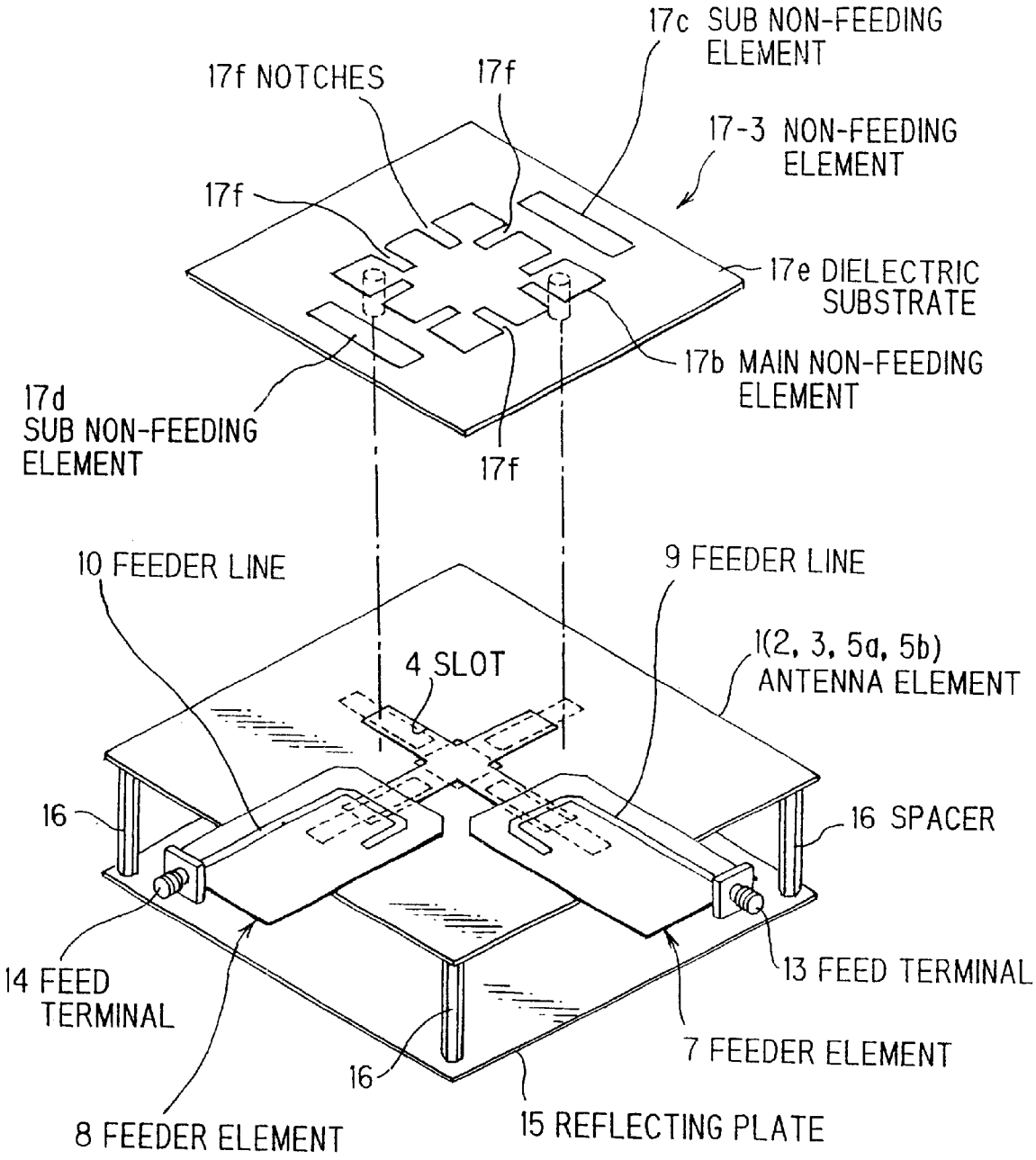
FIG. 11 is an exploded perspective view showing a modified embodiment of the antenna apparatus of the present invention.

With the modified embodiment shown in FIG. 11, by using a non-feeding element 17-3 in which notches 17*f* are formed at the outer margin of the main non-feeding element 17*b* in the center of the non-feeding element 17-2 in the modified embodiment shown in FIG. 10, the impedance is adjusted by the notches 17*f* in the main non-feeding element 17*b* and a sub non-feeding element 17*d*, to thereby change the radio property.

Figure 12:
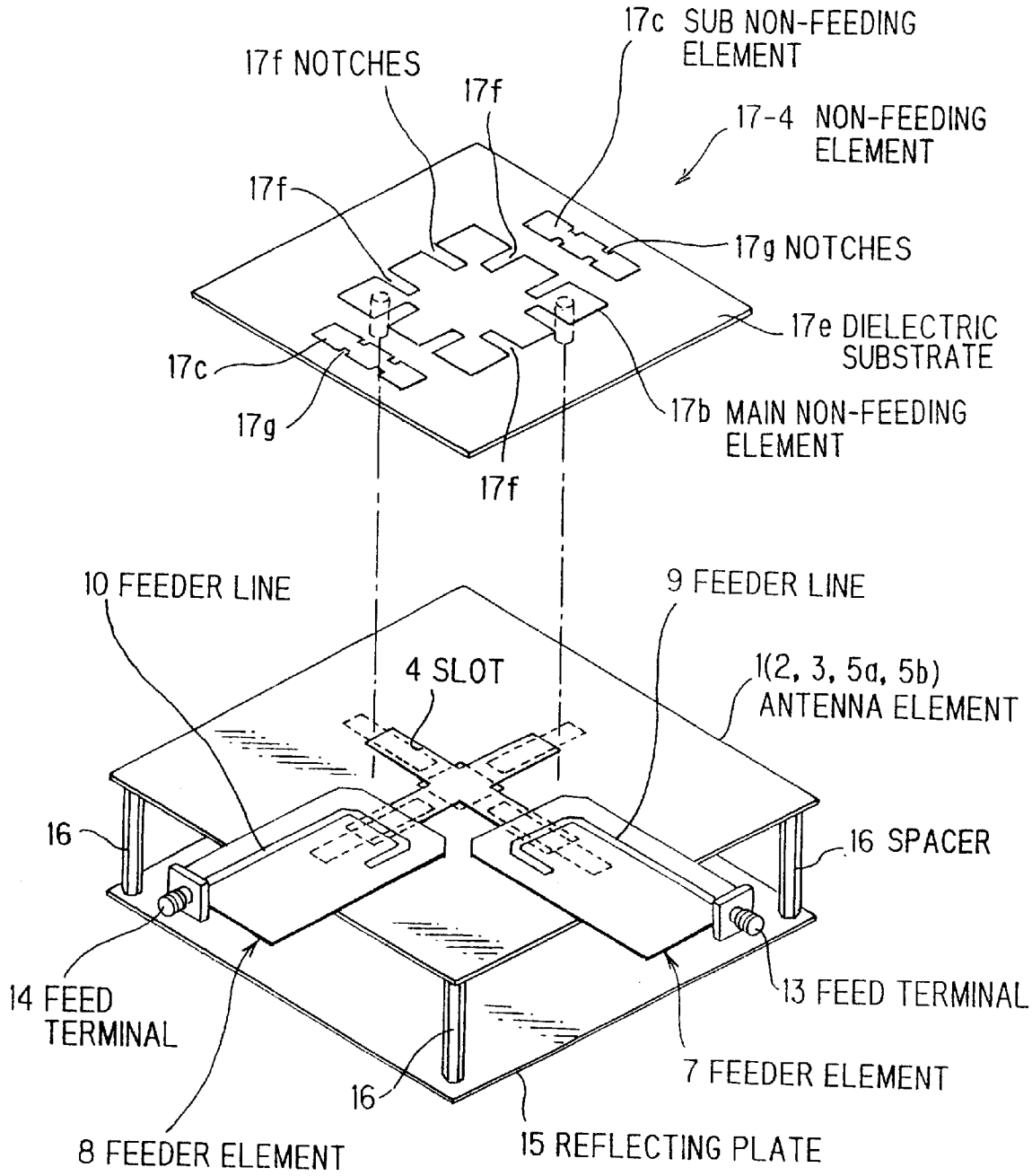
FIG. 12 is an exploded perspective view showing a modified embodiment of the antenna apparatus of the present invention.

With the modified embodiment shown in FIG. 12, by using a non-feeding element 17-4 in which notches 17*g* are formed at the edge on the main non-feeding element side of the sub non-feeding element 17*c* and at the opposite edge thereof in the non-feeding element 17-3 in the modified embodiment shown in FIG. 11, the impedance is adjusted to thereby change the radio property.

Figure 13:
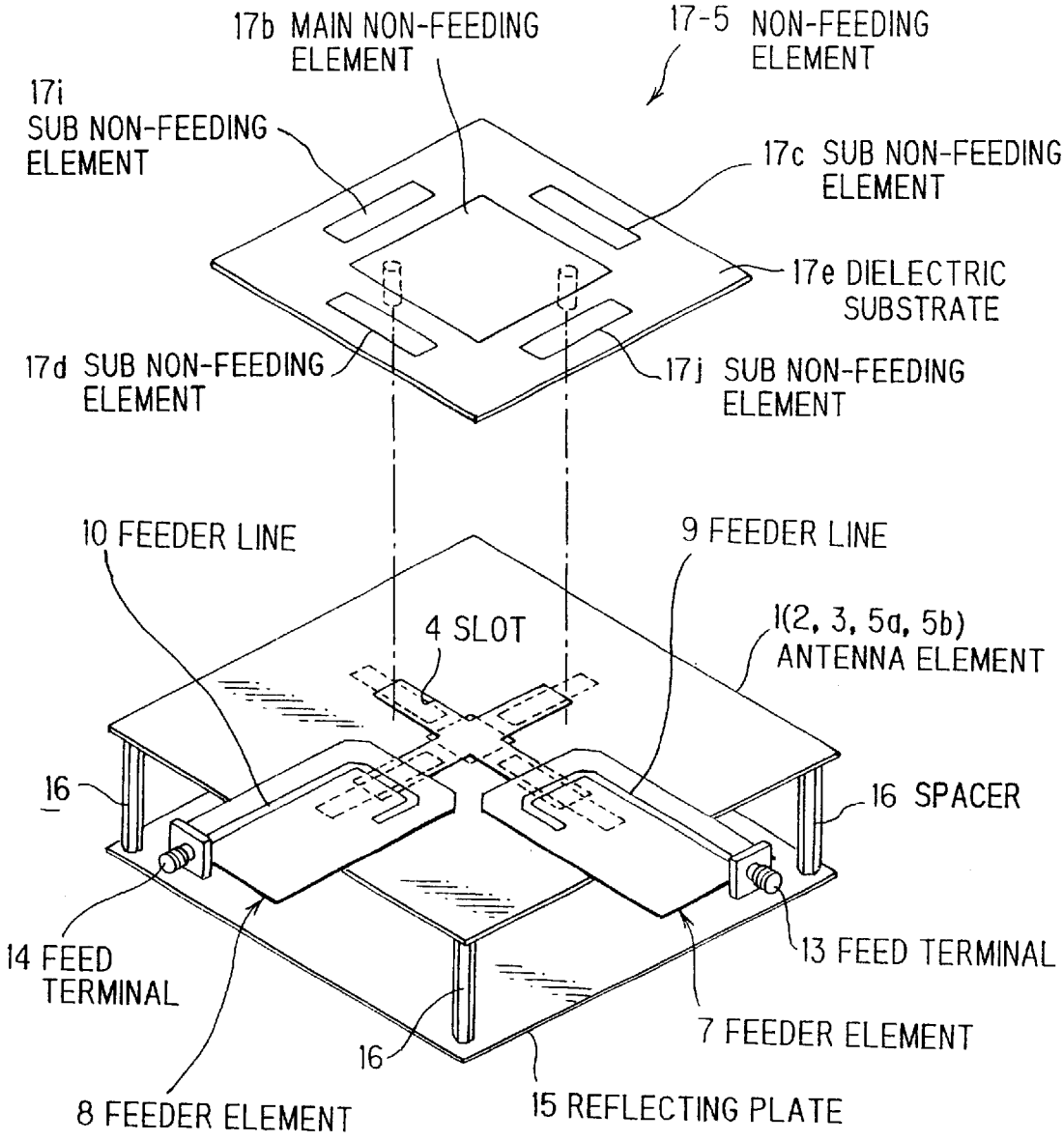
FIG. 13 is an exploded perspective view showing a modified embodiment of the antenna apparatus of the present invention.

With the modified embodiment shown in FIG. 13, by using a non-feeding element 17-5 in which sub non-feeding elements 17*c*, 17*d*, 17*i* and 17*j* are attached in parallel to the four sides of a main non-feeding element 17*a* on a dielectric substrate 17*e*, the impedance is adjusted to thereby change the radio property. These sub non-feeding elements 17*c*, 17*d*, 17*i* and 17*j* are formed by etching a conductive plate of the dielectric substrate, with the conductive plate being adhered on one face thereof.

Figure 14:
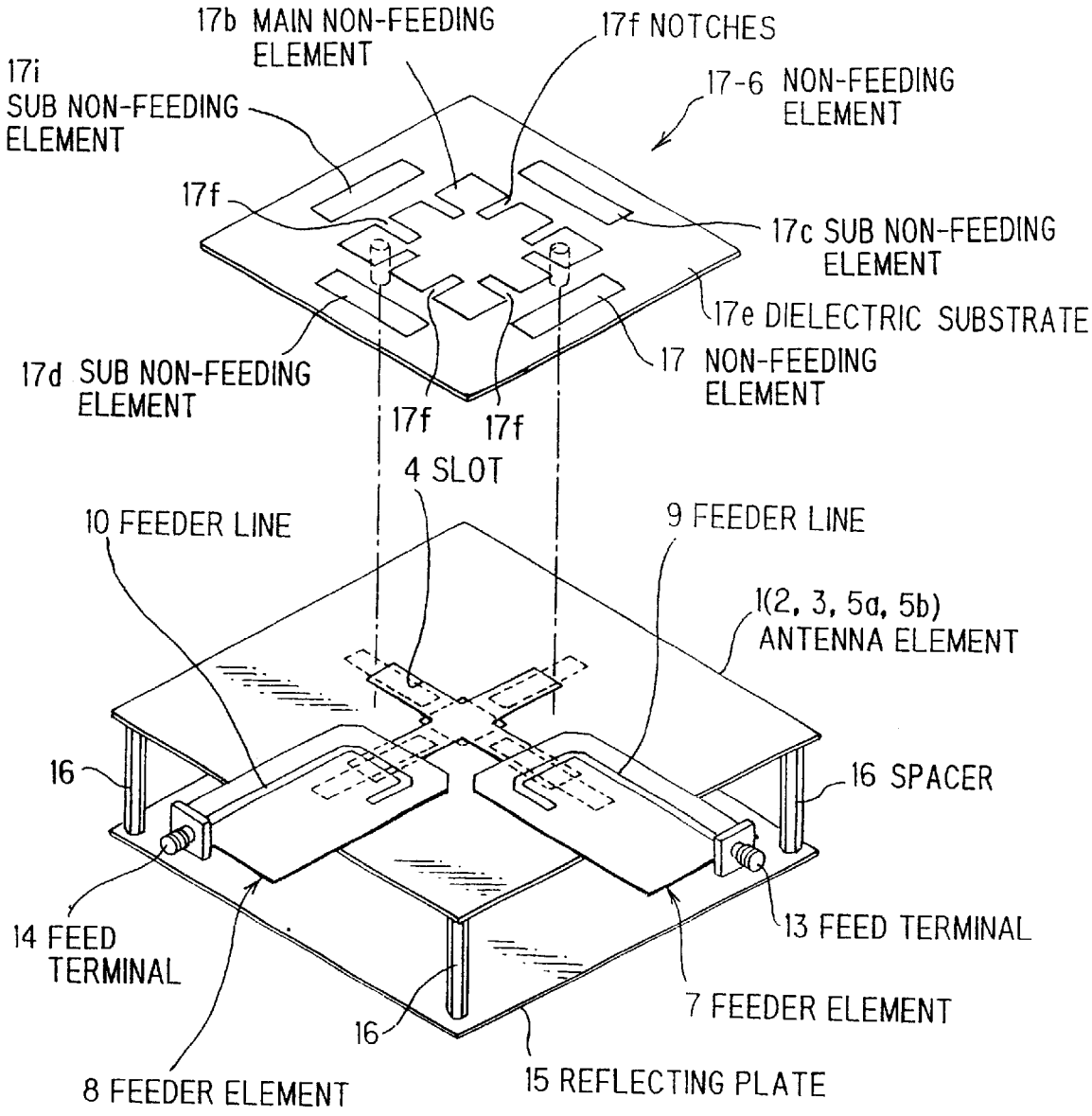
FIG. 14 is an exploded perspective view showing a modified embodiment of the antenna apparatus of the present invention.

With the modified embodiment shown in FIG. 14, by using a non-feeding element 17-6 in which notches 17*f* are formed at each margin of the main non-feeding element 17*b* located at the center of the non-feeding element 17-5 in the modified embodiment shown in FIG. 13, the impedance is adjusted by these notches 17*f* and the sub non-feeding elements 17*c*, 17*d*, 17*i* and 17*j* to thereby change the radio property.

Figure 15:
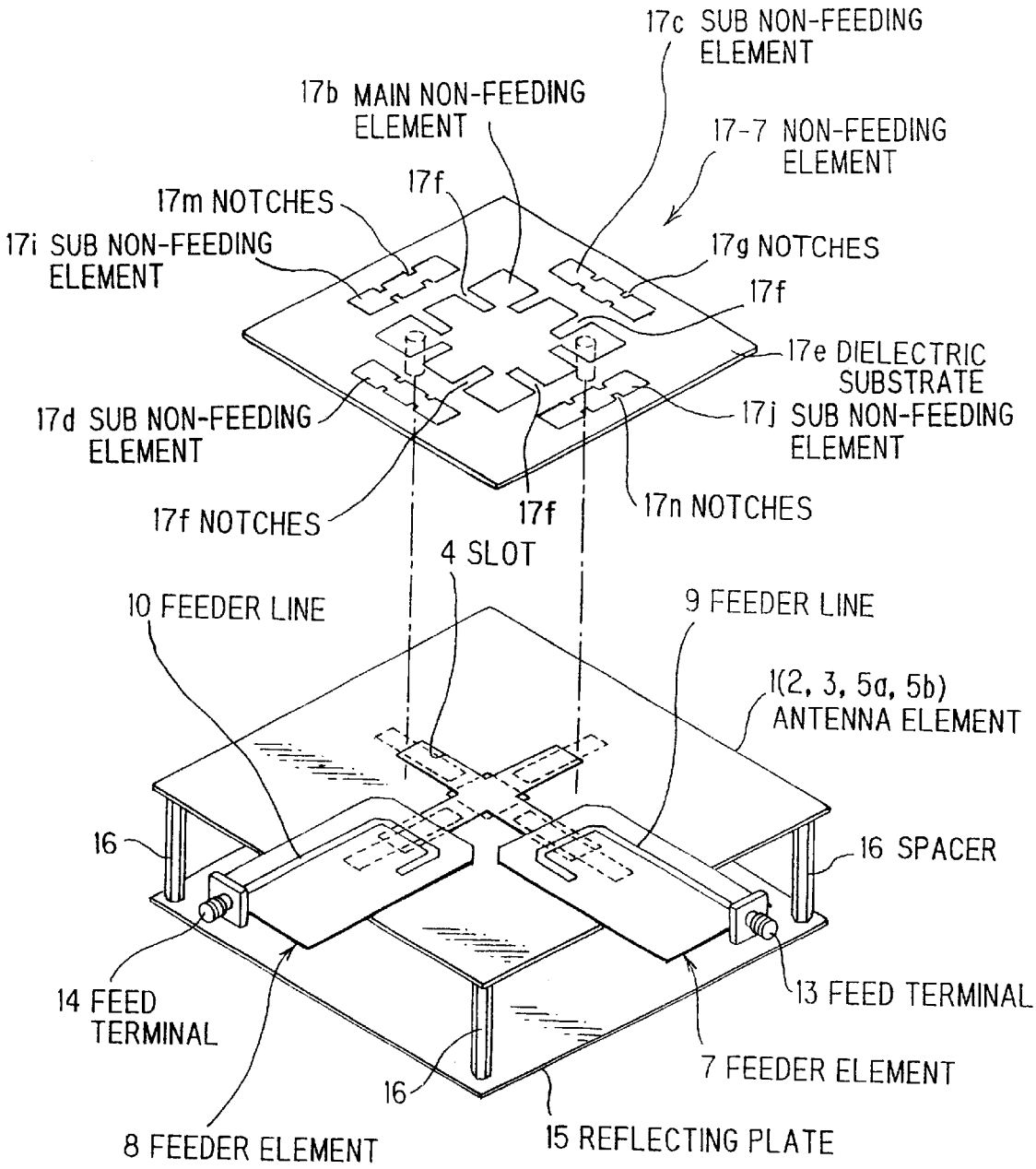
FIG. 15 is an exploded perspective view showing a modified embodiment of the antenna apparatus of the present invention.

With the modified embodiment shown in FIG. 15, by using a non-feeding element 17-7 in which notches 17*g*, 17*h*, 17*m*, 17*n* are formed in each sub non-feeding element 17*c*, 17*d*, 17*i*, 17*j* in the non-feeding element 17-6 in the modified embodiment shown in FIG. 14, the impedance is adjusted to thereby change the radio property.

In the embodiments and modified embodiments described above, the description has been given of a case where a radiation area potential-relaxing conductive parts is attached on the backside of the radiation area of the cross-shaped slot on the other face of the dielectric substrate, but the present invention is not limited thereto, and the radiation area of the slot, the crossing area potential-relaxing conductive part and the radiation area potential-relaxing conductive parts may be formed on the same plane by rotating these by 45 degrees.

Moreover, in the embodiments, the description has been given of a case where a microstriplines is used for the feeder line, but the present invention is not limited to this case, and the antenna structure may be simplified by using a coplanar line.

Figure 16:
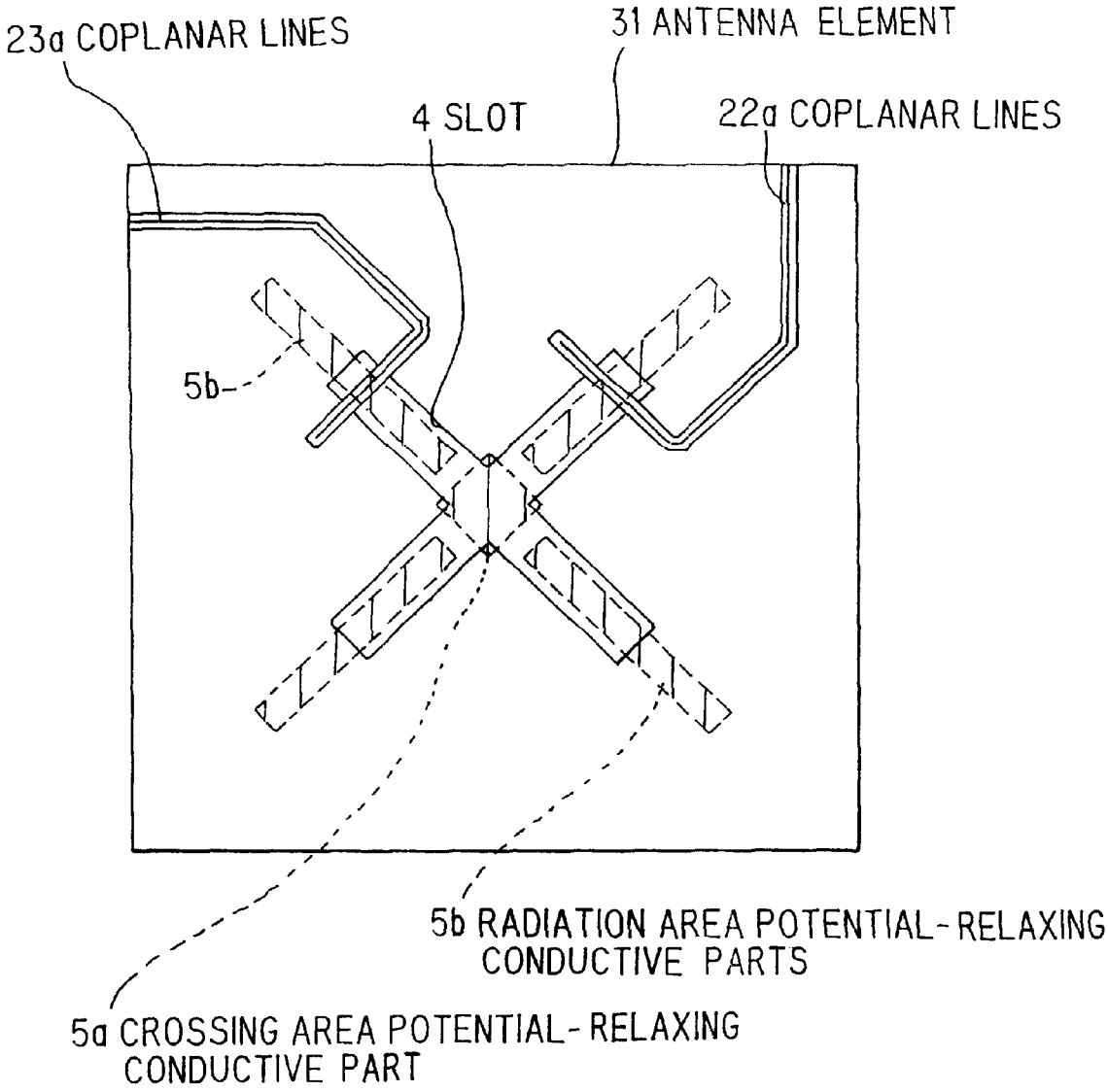
FIG. 16 is an elevational view showing another embodiment of the antenna apparatus of the present invention.

FIG. 16 is an elevational view showing another embodiment of the antenna element of the present invention.

This antenna element 31 is constituted such that a slot 4, a crossing area potential-relaxing conductive part 5*a* and a radiation area potential-relaxing conductive parts 5*b* are rotated by 45 degrees on the same plane, and power is fed by coplanar lines 22*a* and 23*a*.

Figure 17:
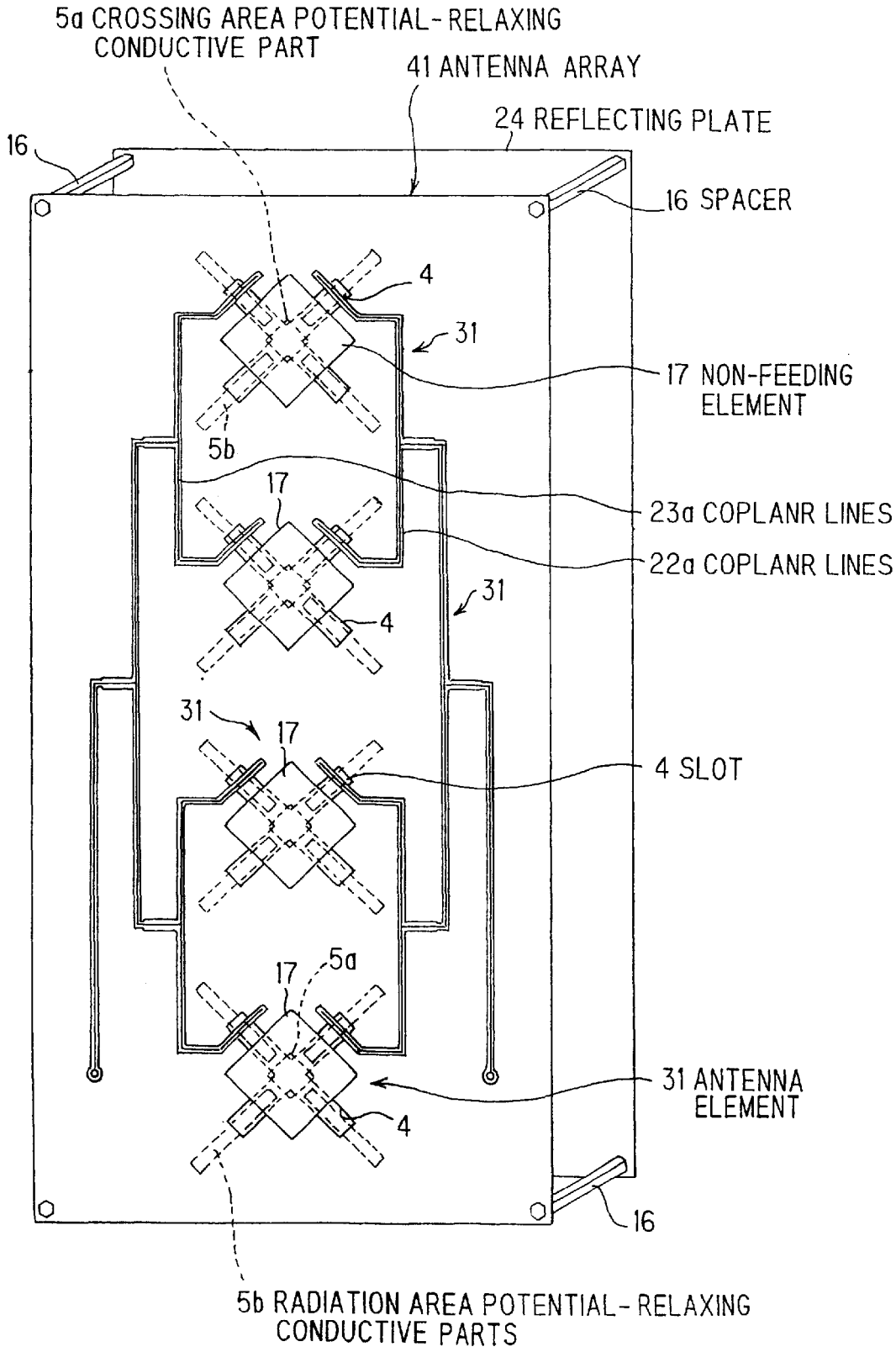
FIG. 17 is a perspective view showing the appearance in another embodiment of the antenna apparatus of the present invention.

FIG. 17 is a perspective view showing the appearance in another embodiment of the antenna element of the present invention.

This antenna element 41 is constituted such that the antenna element 31 shown in FIG. 16 are formed in plural numbers (four in the figure, but the number is not limited thereto) in one line (in the longitudinal direction in the figure) on one dielectric substrate 2. By forming a crossing area potential-relaxing conductive part 5*a* and a radiation area potential-relaxing conductive parts 5*b,* corresponding to each slot 4 of these antenna element 31, a composite antenna array 41 is formed. Power is fed in parallel to each slot 4 of the composite antenna array 41 by coplanar lines 22*a,* 23*a*. A reflecting plate 24 is provided at the rear (on the right side in the figure) of the composite antenna array 41, and a non-feeding element 17 is provided at the front of each slot 4 (on the left side in the figure), respectively.

Figure 18:
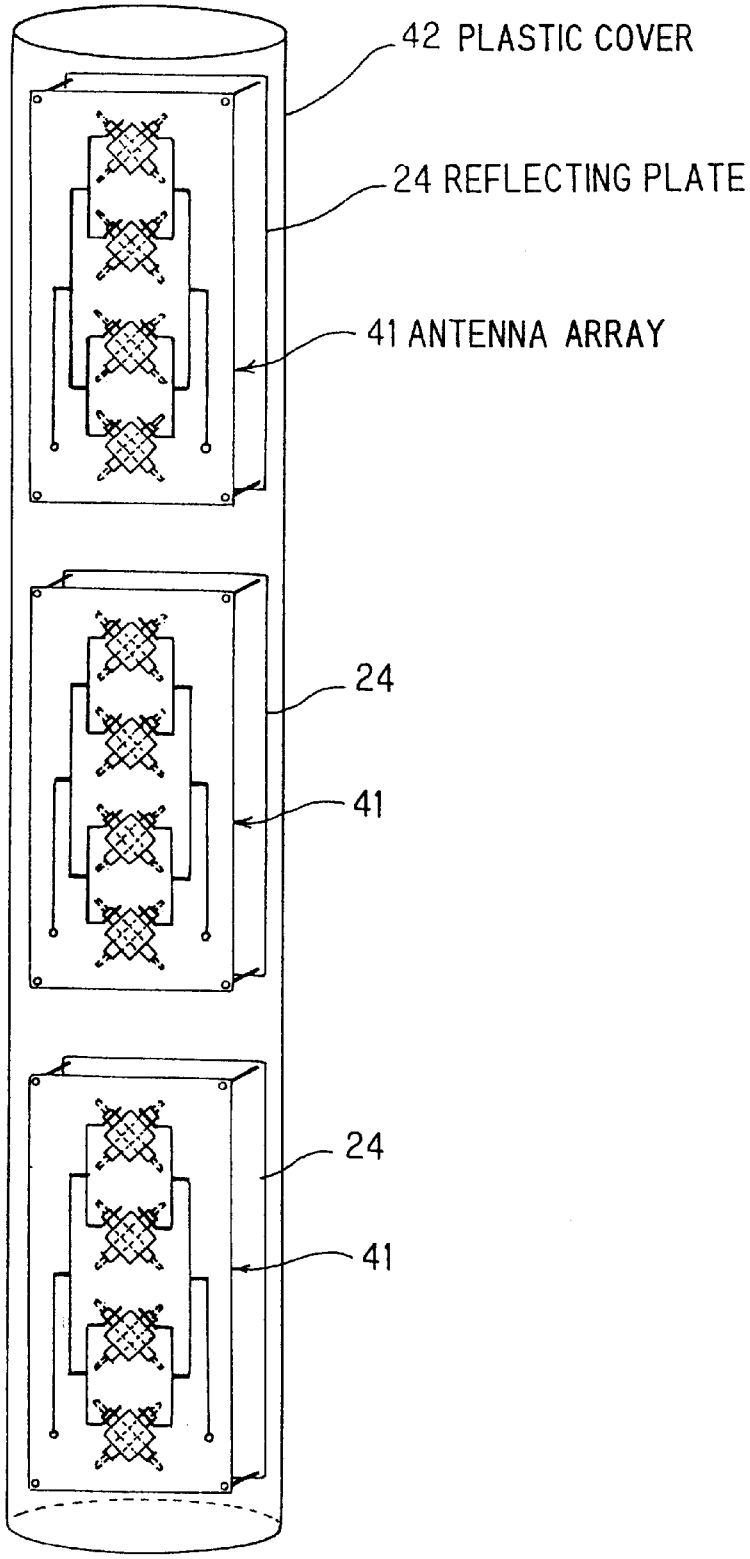
FIG. 18 is a perspective view showing the appearance in another embodiment of the antenna apparatus of the present invention.

FIG. 18 is a perspective view showing the appearance in another embodiment of the antenna apparatus of the present invention.

The antenna apparatus shown in this figure is a multiple-string antenna apparatus formed by arranging the antenna array 41 shown in FIG. 17 in plural stages (three stages in the figure, but the number of stages is not limited thereto) in the perpendicular direction, and covering these with a plastic cover 42.

What is claimed is:

1. An antenna apparatus in which an antenna element comprising a conductive plate having a slot formed thereon is attached to a dielectric substrate, wherein said antenna element comprises: the conductive plate attached to one face of said dielectric substrate and having a cross-shaped slot formed thereon; a crossing area potential-relaxing conductive part attached at the position of a crossing of said cross-shaped slot on the other face of said dielectric substrate; and a plurality of strip-shaped radiation area potential-relaxing conductive parts attached at the position of a radiation area of said cross-shaped slot on the other face of said dielectric substrate.

2. An antenna apparatus according to claim 1, wherein a reflecting plate consisting of a conductor is provided on the other face of said dielectric substrate, via spacers in parallel thereto, so as to cover said dielectric substrate.

3. An antenna apparatus according to claim 2, wherein an electric characteristics adjusting plate consisting of a conductor is provided on one face of said dielectric substrate, via spacers in parallel to said dielectric, so as to cover a central portion of each cross-shaped slot.

4. An antenna apparatus according to claim 2, wherein power is fed in parallel to the radiation area of each slot.

5. An antenna apparatus according to 1, wherein an electric characteristics adjusting plate consisting of a conductor is provided on one face of said dielectric substrate, via spacers in parallel to said dielectric, so as to cover a central portion of each cross-shaped slot.

6. An antenna apparatus according to claim 5, wherein a notch is formed on said electric characteristics adjusting plate.

7. An antenna apparatus according to claim 6, wherein said electric characteristics adjusting plate comprises another dielectric substrate, a main non-feeding element attached on said other dielectric substrate, and a plurality of strip-shaped sub non-feeding elements attached in parallel to an opposing side of said main non-feeding element on said other dielectric substrate.

8. An antenna apparatus according to claim 6, wherein power is fed in parallel to the radiation area of each slot.

9. An antenna apparatus according to claim 5, wherein said electric characteristics adjusting plate comprises another dielectric substrate, a main non-feeding element attached on said other dielectric substrate, and a plurality of strip-shaped sub non-feeding elements attached in parallel to an opposing side of said main non-feeding element on said other dielectric substrate.

10. An antenna apparatus according to claim 9, wherein a notch is formed on at least either one of said main non-feeding element or said sub non-feeding element.

11. An antenna apparatus according to claim 10, wherein power is fed in parallel to the radiation area of each slot.

12. An antenna apparatus according to claim 9, wherein power is fed in parallel to the radiation area of each slot.

13. An antenna apparatus according to claim 5, wherein power is fed in parallel to the radiation area of each slot.

14. An antenna apparatus in which an antenna element comprising a conductive plate having a slot formed thereon is attached to a dielectric substrate, wherein said antenna element comprises: the conductive plate attached to one face of said dielectric substrate and having a plurality of cross-shaped slots formed thereon; a crossing area potential-relaxing conductive part attached at the position of each crossing of each cross-shaped slot on the other face of said dielectric substrate; and a plurality of strip-shaped radiation area potential-relaxing conductive parts attached at the position of each radiation area of each cross-shaped slot on the other face of said dielectric substrate.

15. An antenna apparatus according to claim 14, wherein power is fed in parallel to the radiation area of each slot.

16. An antenna apparatus according to claim 14, wherein a reflecting plate consisting of a conductor is provided on the other face of said dielectric substrate, via spacers in parallel thereto, so as to cover said dielectric substrate.

17. An antenna apparatus according to claim 14, wherein an electric characteristics adjusting plate consisting of a conductor is provided on one face of said dielectric substrate, via spacers in parallel to said dielectric, so as to cover a central portion of each cross-shaped slot.

* * * * *